US006769905B2

(12) United States Patent
Gray et al.

(10) Patent No.: US 6,769,905 B2
(45) Date of Patent: Aug. 3, 2004

(54) MULTILAYERED COMPRESSED CANDLE AND METHOD FOR MANUFACTURE

(75) Inventors: Robert G. Gray, Brantford (CA); Nihila Ravirajan, Oakville (CA); Sandra E. Blevins-Steer, Racine, WI (US); Kathryn H. Ferguson, Chicago, IL (US); Georgia A. Tenhagen, Elkhorn, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 54 days.

(21) Appl. No.: 10/316,463

(22) Filed: Dec. 11, 2002

(65) Prior Publication Data

US 2003/0134244 A1 Jul. 17, 2003

Related U.S. Application Data

(60) Provisional application No. 60/345,071, filed on Jan. 4, 2002.

(51) Int. Cl.[7] ..... F23D 3/16; C11C 5/00

(52) U.S. Cl. ..... 431/288; 431/126; 44/275; 264/245

(58) Field of Search ..... 44/275; 431/288, 431/289, 291, 126; 264/245

(56) References Cited

U.S. PATENT DOCUMENTS

| | | | |
|---|---|---|---|
| 3,254,512 | A | 6/1966 | Prentice |
| D209,487 | S | 12/1967 | Crumrine, Jr. |
| 3,385,649 | A | 5/1968 | Hicks |
| 3,388,960 | A | 6/1968 | Cangialosi |
| D216,569 | S | 2/1970 | Reiher |
| 3,702,495 | A | 11/1972 | Renoe |
| 3,706,523 | A | 12/1972 | Kumm |
| 3,826,606 | A | 7/1974 | Hicks |
| 3,898,039 | A | 8/1975 | Lin |
| 4,077,110 | A | 3/1978 | Reiher |
| 4,320,575 | A | 3/1982 | Karlsson |
| 4,427,366 | A | 1/1984 | Moore |
| 4,449,987 | A | 5/1984 | Lindauer |
| 4,568,270 | A | 2/1986 | Marcus et al. |
| 4,614,625 | A | 9/1986 | Wilson |
| 4,770,849 | A | 9/1988 | Page |
| 4,826,428 | A | 5/1989 | Lam |
| 5,087,398 | A | 2/1992 | Le Molaire et al. |
| 5,089,256 | A | 2/1992 | Scheller et al. |
| D375,566 | S | 11/1996 | Harter |
| 5,693,273 | A | 12/1997 | Wolbrom |
| 6,019,804 | A | 2/2000 | Requejo et al. |
| 6,079,975 | A | 6/2000 | Conover |
| 6,129,771 | A | 10/2000 | Ficke et al. |
| 6,203,313 | B1 | 3/2001 | Holmes et al. |

FOREIGN PATENT DOCUMENTS

| | | | | |
|---|---|---|---|---|
| DE | 2445265 A | * | 4/1976 | |
| DE | 29 32 111 | | 2/1981 | |
| EP | 0 719 855 A1 | | 7/1996 | ..... C11C/5/00 |
| EP | 0 994 177 A2 | | 4/2000 | ..... C11C/5/00 |

* cited by examiner

*Primary Examiner*—Jiping Lu

(57) ABSTRACT

A compression-molded candle product having multiple layers and method of maufacture thereof are disclosed. The candle may be optionally configured to dispense one or more volatile additives. The additive may be fragrances, sanitization agents, deodorants, insect control compounds or any other volatile material, or mixture thereof. The candle may optionally have separate colorants in each layer.

30 Claims, No Drawings

MULTILAYERED COMPRESSED CANDLE AND METHOD FOR MANUFACTURE

CROSS REFERENCES TO RELATED APPLICATIONS

This application claims the benefit of U.S. Provisional Application No. 60/345,071 filed Jan. 4, 2002.

TECHNICAL FIELD

This invention relates to the dispensing of one or more volatile active air materials from a candle product. More specifically, this invention relates to a process for manufacturing a compression-molded candle product having multiple layers, each having a different color or appearance. Optionally one or more additives may be included in each layer. The additive may be a fragrance, sanitization agent, deodorant, insect control compound or any other volatile material, or mixture thereof which is desired to be distributed and which may be combined with the fuel of the candle. When the additive is a fragrance it is preferred that no two immediately adjacent layers of the candle contain the same fragrance.

BACKGROUND OF THE INVENTION

Candles have been known and used since early civilization. A typical wax candle is formed of solid or semi-solid body of a fuel source, generally wax such as petroleum derived wax or a burnable synthetic polymer and contains an axially embedded combustible wick.

Candles have become a very popular popular form for the delivery of active ingredients, generally fragrances in recent years. Candles are offered that appeal to both the olfactory as well as the visual sense. This type of candle usually incorporates fragrance oil in the wax body. As the wax is melted in the lighted candle, fragrance oil is released from the liquefied wax pool.

Candles which offer a single fragrance have been offered for several years and have exhibited enormous consumer appeal. Likewise, poured candles having multiple colored layers which sometimes offer a variety of scents in a single form have been sold in the consumer market and have been met with success. One of the problems with producing poured multilayered candles is the time necessary for heating and cooling the solid fuel, generally wax, since each layer must be individually poured and then cooled before an adjacent layer is added. This increases production time, and energy requirements if artificial cooling methods are used to decrease production time. These problems limit the commercial production of multi-layered candles by pour techniques.

Conventional poured fragrance candles have drawbacks and other limitations. Candles are typically prepared by means of melt processing. Wax compositions containing fragrance must be carefully developed and processed to assure a suitable release of fragrance oil from the liquefied wax pool. This process can be difficult and resource intensive. Moreover, candles made with more than one fragrance layer utilizing melt-processing technology are limited to the same drawbacks of cost and other limitations. Clearly, if a technique could be developed for the manufacture of multilayered candles by a compression technique which would be less energy intensive, more adaptable to producing large scale quantities, and which candles would provide the esthetically pleasing multi-colored layers optionally containing a volatile active ingredient for the visual sense now found in poured candles, it would be an advance in the art. Preferably such a candle would contain multiple layers with each layer exhibiting a different color or appearance. Most preferably such a candle includes multiple layers with each layer exhibiting a different color or appearance, and each layer containing a fragrance or perfume, with the proviso that no two adjacent layers can contain the same fragrance or perfume.

It is accordingly an object of this invention to provide to the art a method for the manufacture of a multi-layered candle product. It is another object of this invention to provide to the art a method for the manufacture of a multilayered candle product which is capable of dispersing a volatile active material such as a fragrance, insect control agent, sanitization aid, deodorant, or the like. It is yet another object of this invention to provide to the art a multilayered compression candle product which is esthetically pleasing and can be utilized for the dispersal of a volatile active material. Another object of the invention is to provide to the art a multilayered compression candle with each layer having a color different than any other adjacent layer, and each layer in addition contains a fragrance which is different than any other adjacent layer. Other objects and advantages shall become apparent from the accompanying description of the invention and examples.

DESCRIPTION OF THE INVENTION

The multilayered candle products of the instant invention are made by compression technique such as that exemplified in Requejo et al. U.S. Pat. No. 6,019,804 the disclosure of which is hereinafter incorporated by reference into this specification. In Requejo, wax prill containing additives such as colorants or fragrancing agents are compressed to form candle products having exceptional properties. Requejo however discloses only the formation of a candle product having one layer, or, a homogeneous candle product including only one set of additives. The wax prill used to form the candle products of Requejo can be formed for example by the techniques disclosed in U.S. Pat. No. 4,614,625 to Wilson, the disclosure of which is also hereinafter incorporated by reference into this specification.

By adding successive layers of prill into a compression candle mold, compressing the wax prill to form a wax body, and then adding an appropriate wick, a suitable multilayered compression candle product can be produced. This process will be further exemplified and explained below.

The basic process utilized to form the multilayered compression candle products of this invention includes the steps of:

a. Preparing x+1, where x is a whole number equal to or greater than 1, solid-fuel prill or powder layer mixtures, each layer mixture containing a compatible solid fuel having a particle size of from about 500 to about 2000 microns and preferably about 600–1190 microns, with the proviso that when added to the candle mold, no two immediately adjacent mixture layers will have the same color or appearance, and each layer mixture optionally containing one or more different additives from the group consisting of fragrances, insect control agents, sanitization aids, deodorants, or the like and mixtures thereof. When the additive is a fragrance it is preferred that no two adjacent mixture layers contain the same fragrance.

b. Adding the x+1 layer mixtures of step a to a candle mold in a sequential manner so that no adjacent layer mixture within the mold have the same color or appearance, each layer mixture being added to the mold in a quantity to produce a layer having a desired thickness after the compression step of step c;

c. Subjecting such layer mixtures in the mold to a compressive force to form a candle shape within the mold, said candle shape having a substantially horizontal upper surface, a substantially horizontal lower surface, and one or more vertical surfaces communicating with said upper and lower surfaces defining the candle shape, said candle shape having x+1 layers, each layer having a desired thickness;

d. Forming either during step "c" or thereafter one or more axially disposed vertical wick cavities within such candle shape;

e. Placing a combustible wick within each such axially disposed vertical wick cavity; such wick being placed to extend a flame sustaining distance above the substantially horizontal top of such candle to at or near the horizontal bottom layer of such candle shape; and then, f. Recovering a multilayer compression candle.

Optionally, one or more axially disposed vertical wicks can be inserted into the candle during the compression molding process and thus, no wick cavity need be formed, or subsequent wick insertion step need to taken to produce the candles of this invention.

The solid fuel used in the preparation of the candle products of the instant invention is made from a solid fuel prill or solid fuel powder. Processes for making solid fuel prill or powder useful in candle manufacture are found in U.S. Pat. No. 4,641,625 and U.S. Pat. No. 6,109,804. The solid fuel used in this invention may be a conventional paraffin wax, natural wax, synthetic polymer or the like. Waxes useful in the subject invention should be solid at room temperature, water repellent, smooth texture, primarily hydrocarbon (hydrogen and carbon) in structure, low toxicity, low odor, combustible, and have low reactivity. Waxes useful in the invention can come from any of five major sources including animals (beeswax), plants (soy and carnauba waxes), minerals (montan wax), petroleum (paraffin wax), and materials produced by chemical synthesis (polyethylene and Fischer Tropsch).

In a preferred embodiment of this invention the solid fuel is a paraffin wax material. Paraffin wax materials of this type are well known and are available from a variety of sources and suppliers such as The International Group, Inc., Exxon/Mobil Corporation, Chevron Products Company Lubricants & Specialty Products as well as other suppliers. In a preferred embodiment of this invention the paraffin wax is a refined paraffin wax having a melting point in the range of about 130–150° F., and a maximum oil content of about 1.0%. The amount of oil content in the paraffin is limited in that excessive amounts of oil affect the quality of the resultant compressed candle product. Such refined paraffin waxes are known to those skilled in the art, and are exemplified by IGI Paraflex 1239 from The International Group, Inc., Toronto, Ontario, Canada.

The solid fuel fuel source used in the preparation of the candle products of this invention may be formulated with additional additives. These additives may include:

a. microcrystalline wax materials having a melt point in the range of 150–170 F;

b. $C_{14}$–$C_{20}$ fatty acids;

c. wax crystal modifiers;

d. stability additives including ultra-violet stabilizers e. colorants; and f. volatile active additives from the group consisting of perfumes, deodorants, sanitization agents, and the like;

The microcrystalline wax materials are generally petroleum waxes derived from short residues (vacuum distillation residues) or by processing tank bottom wax or sucker rod wax. Typical grades show a much finer crystal structure than paraffin waxes and the ability to form smooth mixtures with oil or solvent. The lower melting grades (e.g. in range 135–145° F.) are very flexible and adhesive, and contain a wide range of molecular types including a high proportion of 'non-normal' paraffins. These materials are utilized to improve the quality of the finished candle product, and the burn of the finished candle product. Microcrystalline wax materials are available from a number of sources. A preferred microcrystalline wax material is Bareco Victory Lite wax which is available from Bareco Products of Rock Hill, S.C. When utilized, the microcrystalline wax is generally present at a level of from about 0.5 to about 5.0 weight percent of the prill, preferably from about 1 to about 4 weight percent of the prill and most preferably from about 1.5 to about 3 weight percent of the prill. As used herein the term "prill" is meant to include particles of the solid fuel including powders, and is defined by the particle size ranges provided herein.

The $C_{14}$–$C_{20}$ fatty acid ingredient is also commercially available, usually as a mixture of fatty acids such as stearic acid, palmitic acid and oleic acid. These materials may be utilized to improve the finished candle product. The $C_{14}$–$C_{20}$ fatty acid may be utilized in the manufacture of the candles of this invention at a level from about 1 to about 20 percent by weight of the prill, preferably from about 3 to about 8 percent by weight of the prill, and most preferably from about 3.5 to about 6 weight percent of the prill. Fatty acids are offered for sale by a variety of manufacturers including Akzo Nobel Chemicals, Inc., Witco Corporation, Henkel Corp. Chemicals Group, and the like.

The wax crystal modifiers that may be used in the practice of this invention are generally ethylene and alpha olefin polymers and copolymers that act to modify the crystal behavior of the paraffin wax. These polymers have an ability to bind oil, thereby increasing the hardness and opacity of paraffin wax. These polymers may include ethylene-maleic anhydride copolymers, ethylene-alpha olefin copolymers, poly alpha olefins, and the like. Suitable wax crystal modifiers are available from a variety of sources. A preferred wax crystal modifier is a poly alpha olefin material sold under the trade mark Vybar® 103 which is available from The Polymers Division of Baker Petrolite Corporation, St. Louis, Mo. Those skilled in the art will be aware of the great variety of wax crystal modifiers available which may be utilized in the manufacture of the candles of this invention. The wax crystal modifiers are typically used at a level from about 0.5 to about 10 percent by weight of the prill, and preferably from about 1 to about 8 percent by weight of the prill, and most preferably from about 1.5 to about 4 weight percent of the prill or powder.

The optional stability agents include materials which act to stabilize ingredients in the candle, specifically colorants, against UV degradation.

The colorant is an optional ingredient, and can comprise one or more pigments and dyes in a quantity between about 0 to about 2 weight percent and preferably 0.00001 weight percent to about 0.01 weight percent of the prilled wax composition. A pigment constituent preferably is an organic toner in the form of a fine powder suspended in a liquid medium such as a mineral oil. A dye constituent normally is dissolved in an organic solvent such as toluene or xylene. A variety of pigments and dyes suitable for candle making are listed in U.S. Pat. No. 4,614,625. The candle product of this invention can be made with no pigment or dye so long as the color or appearance of immediately adjacent layers is distinguishable to a consumer. Likewise, it is preferred to use oil soluble dyes as the colorants for the candle of this invention since pigments, being solid, can sometimes operate to clog the wick of a burning candle. Pigments can however be used as the colorants in this invention if they are carefully selected, and used at appropriate levels where clogging can be minimized. Pigments may be used as overdips or the like to the candles of this invention where clogging is not a factor. Because the lack of a colorant will also define a different appearance of the candle product, colorant as used herein can also mean the absence of a colorant. Likewise, different levels of a colorant or a combination of colorants can be used to form different shades of a color, for example a blue dye can be used to form a powder blue color, and in greater quantity a navy blue, and the term colorant is thus also meant to include variations in the level of one or more dyes or pigments used to obtain different shades of the same color.

The preferred volatile active additive for use in the candles of this invention is an air freshener ingredient. When utilized, the volatile active may be present at a level of from about 0 to about 20 weight percent of the prill, and preferably from about 1.0 to about 10 weight percent. Most preferably, from about 2.0 to about 5.0 weight percent of the prill is composed of the volatile active ingredient. Air freshener ingredients are preferably liquid fragrances or perfumes comprising one or more volatile organic compounds which are available from perfumery suppliers such International Flavors & Fragrances, Firmenich International SA, Takasago International Corp. USA, Noville Inc., Quest Co., and Givaudan SA.

Most conventional fragrance materials are volatile essential oils. The fragrance can be a synthetically formed material, or a naturally derived oil such as oil of Bergamot, Bitter Orange, Lemon, Mandarin, Caraway, Cedar Leaf, Clove Leaf, Cedar Wood, Geranium, Lavender, Orange, Origanum, Petitgrain, White Cedar, Patchouli, Lavandin, Neroli, Rose absolute, and the like.

A wide variety of chemicals are known for perfumery such as aldehydes, ketones, esters, alcohols, terpenes, and the like. A fragrance can be relatively simple in composition, or can be a complex mixture of natural and synthetic chemical components.

A typical scented oil can comprise woody/earthy bases containing exotic constituents such as sandalwood oil, civet, patchouli oil, and the like. A scented oil can have a light floral fragrance, such as rose extract or violet extract. Scented oil also can be formulated to provide desirable fruity odors, such as lime, lemon or orange.

Synthetic types of fragrance compositions either alone or in combination with natural oils are described in U.S. Pat. Nos. 4,314,915; 4,411,829; and 4,434,306; incorporated herein by reference. Other artificial liquid fragrances include geraniol, geranyl acetate, eugenol, isoeugenol, linalool, linalyl acetate, phenethyl alcohol, methyl ethyl ketone, methylionone, isobornyl acetate, and the like.

The volatile active ingredient also can be a liquid formulation containing an insect repellent such as citronellal, or a therapeutic agent such as eucalyptus or menthol. The volatile active agent can be any material which can be incorporated into the solid fuel source and which can be volatilized by the heat of burning the solid fuel source. The volatile active may be a sanitization agent such as for example triethyleneglycol.

In selecting the additives for the multilayered candle of the invention, it is sometimes appropriate to consider having fragrances in adjacent layers be complimentary so as to cause the fragrances between successive layers to blend, or to form a fragrance release that is nonobjectionalble to one's olfactory sense. The same is true of color selection between adjacent layers of the multilayered candle. Here too, selection of colors between adjacent layers can be important in creating a suitable esthetic appearance. Further, in the selection of actives between two adjacent layers, it is permissible within the scope of this invention to place a non-fragranced layer between two fragranced layers. The two fragranced layers between the non-scented layer may be of the same or different fragrance. When selecting colors for each layer of the multilayered candle no two adjacent layers may be of the same color, but, layers separated by a different color can be of the same color and/or fragrance. Thus, fragrance and or color can repeat, so long as the color or fragrance does not repeat in an immediately adjacent layer. It is also within the scope of this invention to create a non-scented candle, where only the color between two adjacent layers is different, and no volatile additive is present.

The candle product of the instant invention as stated above is formed by compression of solid fuel, preferably paraffin wax. In another embodiment this invention provides a process which comprises compression-molding prilled wax or powder compositions to form a multiple layered candle product which has a density about 0.80 to about 0.92 and preferably about 0.85 to 0.92 grams per cubic centimeter; wherein the prilled wax composition is a blend of ingredients comprising:

(a) between about 60 and about 95% and preferably about 70 to about 93 weight percent of refined paraffin wax having a melting point in the range of about 130° and 150° F. and preferably 135° F. to about 145° F., a maximum oil content of about 1.0%;

(b) between about 0 and 20 weight percent and preferably 1 to 3.5 weight percent of microcrystalline wax having a melt point in the range on 150 to 180° F.;

(c) between about 2 and 20 weight percent and preferably 3 to 8 weight percent of a $C_{14}$ to $C_{20}$ fatty acid ingredient;

(d) between 0 and 5 weight percent and preferably 1 to 5 weight percent of a polymeric wax crystal modifier;

(e) between about 0 to 10 weight percent of a volatile active ingredient; and (f) between about 0 and 2 weight percent of colorant ingredient; wherein the prilled wax composition has a powder density between about 0.50 and 0.65 grams per cubic centimeter.

Equipment and procedures for wax powder compression are described in publications such as "Powder Compression of Candles" by M. Kheidr (International Group., 1990) incorporated by reference. Compression molding can be conducted under conditions comprising a molding force between 2000 and 4000 pounds force and preferably from 2400 to 2800 pounds. Most preferably a compression pressure between 2400 and 2600 pounds is utilized. Compression times can range between about 1 and about 20 seconds and a prilled wax temperature between 15° C. and 25° C.

The particle size distribution of the prilled wax composition allows for suitable properties of the final product and is described as having a powder density between about 0.50 to 0.65 grams per cubic centimeter and subsequently allows the compression molding of a multiple layered candle product to have a density between about 0.80 to 0.92 grams per cubic centimeter. This process is described in U.S. Pat. No. 6,019,804 previously incorporated herein by reference.

In another embodiment, this invention includes prilled wax compression molded candles which offer superior performance from the compression of prilled wax, which forms small uniform wax crystal compositions, that when compression molded into finished candles can provide even burning throughout the candle and well as from one layer into another.

In another embodiment, the invention provides a compression molded candle product which has an axially disposed vertical wick, or multiple axially disposed vertical wicks, which is a fused blend of ingredients comprising;

(a) between about 60 and 95% weight percent of refined paraffin wax having a melting point in the range of about 130 and 150° F. and a maximum oil content of about 1.0%, (b) between about 0 and 20 percent of microcrystalline wax having a melt point in the range on 150 to 180° F., (c) between about 2 and 20 weight percent of a $C_{14}$ to $C_{20}$ fatty acid ingredient, (d) between 0 and 5 weight percent of a polymeric wax crystal modifier ingredient;

(e) between about 0 to 10 weight percent of a volatile active ingredient, and (f) between about 0 and 2 weight percent of colorant ingredient; wherein the prilled wax composition has a powder density between about 0.50 and 0.65 grams per cubic centimeter.

One of the essential aspects of the present invention is the manufacturing process for a prilled wax, multiple layered compression molded candle. The invention provides a compression molded candle product, which is comprised of prilled wax compositions that are arranged in an ordered fashion into individually fragranced, colored layers and has a density between about 0.80 and 0.92 gram per cubic centimeter. In another embodiment of the present invention, the candle product can have an applied coating medium (i.e. an overdip) having a thickness between 0.2 and 0.9 millimeters on the candle surface. This overdip coating medium may be smooth or textured.

Suitable coating compositions can include one or more ingredients selected from the group consisting of microcrystalline wax paraffin wax, natural wax, fatty acids and amides, polyolefins and celluloses.

In another embodiment of the present invention, the candle product can have a smooth or textured surface finish depending on how the candle is treated both in the mold, and during mold removal. A smooth finish can be obtained by applying a heat source to the compression mold while the candle is being compressed, which yields a hardness to the candle surface and having a thickness between 0.2 to 0.9 millimeters. A textured surface can be processed into the candle product as the candle is evacuated from the compression mold, or the mold utilized can be configured to leave a desired impression on the candle.

The candle product of the present invention is characterized by a superior combination of density and hardness. With respect to the combustion performance, a present invention candle product can maintain a wick flame height between 1 and 4 centimeters during the period of wick burn.

The candle product of the present invention develops a sidewall effect during combustion. The formation of sidewalls under normal wick burn conditions is to provide containment of the flame within the candle to allow for optimum air freshener ingredient release. Formation of sidewalls also gives aesthetic benefits (walls appear to glow when flame is contained inside), maintains the layered appearance through life (walls remain intact, so you can still see the multiple layers), and helps to contain the molten pool to prevent cratering. Under wick burn conditions, a molten wax concavity development in the candle matrix typically has an axial depth between 3 and 10 millimeters.

The candle product of the present invention can be in the form of a freestanding candle which may be cylindrical, oval, square, triangular, octagonal, rectangular, hexagonal or any combination or sidewall formation thereof, and of cylindrical, pyramidal, spherical, semi-spherical, egg or cube shaped and typically has a diameter between about 3.5 and about 25 cm and preferably from about 5 to about 15 cm and most preferably from about 7.4 to about 8 cm. The candle products of the instant invention can have a height between 7.5 and 25 cm, and preferably from about 10 to about 13 cm. Most preferably the candle product of the instant invention will have a height of from about 10 to about 10.5 cm. A free standing pillar candle made in accordance can exhibit a burn rate between 2 and 5 grams per hour with centrally positioned wick(s) of braided cotton, cotton/paper cotton/linen, or synthetic wick material such as rayon. A preferred wick material is cotton with or without paper braid or a paper core.

A present invention candle product can be positioned in or upon a holder or container or glass or metal or non-flammable compositions such and plastics or mineral origin, or may be positioned upon a suitable non-flammable surface.

Wicks utilized for the candles of the instant invention are available commercially. Those skilled in the art of candle making will be able to readily determine appropriate wick materials and suppliers based upon the solid fuel utilized, the volatile active ingredient included in the formulation, the desired rate of burn, and the like.

The following examples are further illustration of the present invention. The components and specific ingredients are present as being typical and various modifications can be derived in view of the foregoing disclosure within the scope of this invention.

EXAMPLE I

This example illustrates the preparation of a prilled wax composition and multiple layered, compression molded candle having 3 layers (x=2) in accordance with the present invention.

For a composition of a layer, a refined paraffin wax (IGI Paraflex 1239 MP 60° C.); is pre blended with an ethylene derived polymer (Vybar 103, MP 76° C.) until the polymer is fully integrated into the refined paraffin wax. A fragrance/dye/UV inhibitor concentrate of IFF Stargazer 18 (available from International Flavors & Fragrances), Sandoplast Yellow 3G, Sandoplast Red 2G (both available from Clariant Gmbh, Pigments and Additives Division, Frankfurt) and Cyasorb UV 531 (available from Cytec Industries, Inc., West Patterson, N.J.) is mixed until all components are dissolved.

The following four streams: wax/polymer pre-blend, fragrance/dye/UV inhibitor concentrate, stearic acid (Emersol 150 MP 65.5° C. available from Henkel Corp.), and microcrystalline wax (Bareco's Victory Lite Wax MP 80° C.) are melted simultaneously to the formula using a four head metering system) and blended through an in-line blending process.

Separately and simultaneously, additional compositions are prepared using the same method of mixing. For the second layer, a refined paraffin wax (IGI Paraflex 1239 MP 60° C.); is pre blended with Vybar 103 until the polymer is fully integrated into the refined paraffin wax. A fragrance/dye/UV inhibitor concentrate of IFF 1814 HBA, Clariant Sandoplast yellow 3G and Cyasorb UV 531 is mixed until all components are dissolved. The wax/polymer pre-blend and the fragrance/dye/UV inhibitor concentrate are further blended through an in-line blending process with the same stearic acid and microcrystalline wax used in layer mixture 1. A third layer using identical ingredients, except the fragrance/dye/UV inhibitor concentrate was IFF Moonblossom 47, Clariant Sandoplast Green 3G, Nitro Fast Blue 2B and Cyasorb UV 531 is mixed until all components are dissolved. The wax/polymer pre-blend and the fragrance/dye/UV inhibitor concentrate are further blended through an in-line blending process as with the other two layers.

The separate layer mixture-candle wax compositions are held at a temperature of from about 65 to about 80° C. and pumped separately to respective surge tanks until the ingredient mixtures are homogenous. The candle wax compositions are then pumped to respective separate wax reservoirs in a Kurschner wax spray drum system and the compositions are held at a temperature of from about 68 to about 80° C. The spray drums are set to a speed of approximately 42 meters/min. The spray room temperature is held to no greater than about 15° C. and the relative humidity of approximately 50%. The temperature of the spray room may vary based upon the temperature of the material being spray dried, the relative humidity, and the composition of the material being sprayed. Routine experimentation may be necessary to determine optimum temperatures for any individual material at the room temperature and humidity. The candle wax mat for each layer are pumped through a spray manifold system from the spray drum reservoir and sprayed to 15 centimeters above the drum, from nozzles. The wax is sprayed into the air and semi-solidifies before contacting the drum surface. The spray drum is held to a temperature between 7 and 24° C. The prilled wax is collected on the spray drum and them scraped from the drum and transferred into a vibrating conveyer that leads inside the drum for each of the compositions for further cooling. The prilled wax is collected at the end of the drum and vacuum fed into holding separate hoppers. For consistent cavity mold filling and compression for multiple layers in a single mold, the prilled waxes are maintained at temperatures between 17 and 32° C.

The target dimension for the candle directly from the press is 7.60 cm by 10.16 centimeters in dimension. For a pillar candle of this dimension, the total weight is about 366 grams and the weight for each layer is about 122 grams. Weights are given for reference purposes only since the candles are manufactured to meet volume specifications.

EXAMPLE II

This example illustrates the preparation of a multiple layered compression molded candle product in accordance with the present invention.

The prilled candle waxes of Example I are transferred from the spray drum to three separate stationary hoppers and maintained at a temperature between 20 and 32° C. The prilled waxes are transferred from the stationary hoppers to feed tube matrix of the Progressive Automation compression mold pillar candle press. The feed tube matrix consists of 3 rows each containing 6 cavities which are filled with prilled wax for each layer. The feed tube matrix passes over the a stationary table of press and fills one of the two sets of 6 cavity head units with a volume of 122 grams from the feed tube matrix for a layer per candle, until the cavity is filled with a total of 366 grams of prilled wax, thus representing three distinct layers of prilled wax composition in a single candle.

The table then rotates one of the 6 head cavity units filled with the three prilled wax compositions, 180 degrees to a compression station, where the prilled wax is compressed in the cavity from the top down, forming a contour pocket of approximately 40 millimeters by 9.5 millimeters in dimension to the bottom of the candle. The prilled waxes are compressed to a force between 2400 and 2800 pounds, for a dwell time of approximately 5 seconds to produce a candle that is of a density of between 0.83 and 0.92 grams/cubic centimeter, at which time, the cavity molds are heated through the use of a water jacket, to a temperature of between 10 and 40° C.

The compressed candles are then extracted from the cavity molds, then placed onto a pocketed indexing conveyer system, bottom side up to allow for a clearance space for the top of the candle, and transferred to a Progressive Automation wicking machine where cotton, cotton/paper, cotton/linen or a synthetic wicks, with or without paper braids or paper cores having a length of from about 9 to about 11.5 cm from Technical Braiding Gmbh are inserted into the candles from the bottom to allow the wicks to be placed flush to the upper portion of the pocket and to a total depth of ½ inch from the bottom of the candle. While the candles are inverted with the bottom up, the wicked candles are dosed with approximately 0.2 to 0.5 grams of paraffin wax at a temperature between 65 and 85° C. to seal the wicks in place, then transferred onto a second station where the cavity is filled with between 8 and 12 grams of candle wax that has been reclaimed from scrap candles, and at a temperature between 60 and 80° C. and preferably 60–70° C. The candles that have been filled with wax into the bottom cavity are then passed through cooling tunnel at a temperature 13 and 25° C. for a period of approximately 12 to 20 minutes. In the practice of this invention it is necessary that the selected wick extend out of the top of the candle a flame sustaining distance. In practice this distance ranges from about ¼ inch to about 1 inch.

The resultant candles were esthetically pleasing, had satisfactory burn characteristics and emitted fragrance as they burned.

What is claimed is:

1. A method of making a multilayered compression candle in which no two immediately adjacent layers contain the same colorant, which process comprises the steps of:

a. Preparing x+1, where x is a whole number equal to or greater than 1, solid-fuel prill or powder layer mixtures, each layer mixture containing particles of a compatible solid fuel having a particle size of from about 500 to about 2000 microns, each layer mixture containing one or more colorants, and optionally, a volatile active ingredient from the group consisting of fragrances, insect control agents, sanitization agents and deodorants;

b. Adding the x+1 layer mixtures of step a to a candle mold in a sequential manner so that no two immediately adjacent layer mixtures within the mold have the same colorant, each layer mixture being added in a quantity to produce a layer of a desired thickness;

c. Subjecting such layer mixtures in the mold to a compressive force to form a candle shape within the mold, said candle shape having a substantially horizontal top surface, a substantially horizontal bottom surface, and one or more vertical surfaces communicating with said top and bottom surfaces defining the candle shape, said candle shape having x+1 substantially horizontal layers, each layer having a desired vertical thickness;

d. Forming either during step "c" or thereafter one or more axially disposed vertical wick cavities within such candle shape;

e. Placing a combustible wick within each such axially disposed vertical wick cavity; such wick being placed to extend a flame sustaining distance above the substantially horizontal top of such candle to at or near the horizontal bottom layer of such candle shape; and then, f. Recovering a multilayer compression candle.

2. The method of claim 1 wherein each layer mixture contains a fragrance additive, and no two immediately adjacent layer mixtures contain the same fragrance.

3. The method of claim 2 wherein x is 2.

4. The method of claim 2 wherein the compression strength in step c is from about 2400 to about 2800 pounds force.

5. The method of claim 1 wherein each layer mixture is added to the mold in step b in a manner as to produce a unique layered appearance in each candle.

6. The method of claim 5 wherein the candle is a pillar candle having a width of about 5 cm to about 15 cm and a height of about 7.5 cm to about 25 cm.

7. A method for the manufacture of a multilayer compression candle which comprises the steps of:

a. Preparing x+1 where x is a whole number equal to or greater than 1, paraffin wax prill layer mixtures, each layer mixture containing particles of a compatible paraffin solid fuel having a particle size of from about 500 to about 2000 microns and an effective amount of a colorant;

b. Adding such layer mixtures to a candle mold in such a manner that no two immediately adjacent layer mixtures contain the same colorant;

c. Compressing such layer mixtures to form a candle shape within the mold;

d. Forming either during compression or thereafter a wick cavity within such candle shape;

e. Placing a combustible wick within such wick cavity; such wick being placed to extend a flame sustaining distance above the top of such candle; and then, Recovering a multilayer compression candle.

8. The method of claim 7 wherein each layer of the multilayered compression candle comprises:

a. between about 60 and 95% weight percent of refined paraffin wax having a melting point in the range of about 130 and 150° F. and a maximum oil content of about 1.0%, b. between about 0 and 20 weight percent of microcrystalline wax having a melt point in the range on 150 to 180° F., c. between about 1 and 20 weight percent of a $C_{14}$ to $C_{20}$ fatty acid ingredient, d. between 0 and 5 weight percent of a polymeric wax crystal modifier ingredient;

e. between about 0 to 10 weight percent of a volatile active ingredient, and f. between about 0 and 2 weight percent of colorant ingredient; wherein the prilled wax composition has a powder density between about 0.50 and 0.65 grams per cubic centimeter.

9. The method of claim 8 wherein the volatile active ingredient is a fragrance and no two adjacent layers contain the same fragrance.

10. The method of claim 9 wherein x is 2.

11. The method of claim 8 wherein the volatile active ingredient is an insect control additive.

12. The method of claim 8 wherein the volatile active ingredient is a sanitization additive.

13. The method of claim 11 wherein the compression strength in step c is from about 2400 to about 2800 pounds force.

14. The method of claim 11 wherein the mixture is added to the mold in such a manner as to produce a unique appearance in each candle.

15. The method of claim 11 wherein the candle is a pillar candle having an approximate width of about 5 cm to about 15 cm and a height of from about 7.5 to about 25 cm.

16. A multilayered compression candle having been prepared by the steps of:

a. Preparing x+1, where x is a whole number equal to or greater than 1, solid-fuel prill or powder layer mixtures, each layer mixture containing a compatible solid fuel having a particle size of from about 600 microns to about 1190 microns, and each layer mixture containing one or more colorants and optionally, a volatile active ingredient from the group consisting of fragrances, insect control agents, sanitization agents and deodorants;

b. Adding the x+1 layer mixtures of step a to a candle mold in a sequential manner so that no adjacent layer mixture within the mold contains the same colorant each layer mixture being added in a quantity to produce a substantially horizontal layer of a desired thickness;

c. Subjecting such layer mixtures in the mold to a compressive force of from about 2400 to about 2800 pounds force to form a candle shape within the mold, said candle shape having a substantially horizontal top surface, a substantially horizontal bottom surface, and one or more vertical surfaces communicating with said top and bottom surfaces defining the candle shape, said candle shape having x+1 substantially horizontal layers, each layer having a desired vertical thickness;

d. Forming either during step "c" or thereafter one or more axially disposed vertical wick cavities within such candle shape;

e. Placing a combustible wick within each such axially disposed vertical wick cavity; such wick being placed to extend a flame sustaining distance above the substantially horizontal top of such candle to at or near the horizontal bottom surface of such candle shape; and f. Recovering a multilayer compression candle, wherein each solid-fuel prill or powder layer mixture contains:

i. between about 60 and 95% weight percent of refined paraffin wax having a melting point in the range of about 130 and 150° F. and a maximum oil content of about 1.0%;

ii. between about 0 and 20 percent of microcrystalline wax having a melt point in the range on 150 to 180° F.;

iii. between about 2 and 20 weight percent of a $C_{14}$ to $C_{20}$ fatty acid ingredient;

iv. between 0 and 5 weight percent of a polymeric wax crystal modifier ingredient;

v. between about 0 to 10 weight percent of a volatile active ingredient; and, vi. between about 0 and 2 weight percent of colorant ingredient; wherein the prilled wax composition has a powder density between about 0.50 and 0.65 grams per cubic centimeter.

17. The candle of claim 16 wherein the optional volatile active ingredient is a fragrance, and no two immediately adjacent layers contain the same fragrance.

18. The multilayered compression candle of claim 17 wherein the volatile active ingredient is a fragrance and no two layers contain the same fragrance.

19. The multilayered compression candle of claim 18 wherein x is a whole number of from 1–10.

20. The multilayered compression candle of claim 19 wherein x is 2.

21. The multilayered compression candle of claim 19 wherein the fragrance in each layer is complementary to the fragrance in an adjacent layer.

22. The multilayered compression candle of claim 19 wherein the candle has a density about 0.85 to 0.92 grams per cubic centimeter.

23. The multilayered compression candle of claim 17 wherein the volatile active ingredient is citronella.

24. The multilayered compression candle of claim 17 wherein the volatile active ingredient is triethylene glycol.

25. The candle of claim 16 wherein the optional volatile active ingredient is an insect control compound.

26. The candle of claim 16 wherein the optional volatile active ingredient is a sanitization compound.

27. A multilayered compression candle comprising x+1 layers wherein x is a whole number equal to or greater than 1, each layer containing:

i. between about 70 and about 93% weight percent of refined paraffin wax having a melting point in the range of about 130 and 150° F. and a maximum oil content of about 1.0%;

ii. between about 1 and about 3.5 weight percent of microcrystalline wax having a melt point in the range on 150 to 180° F.;

iii. between about 3 and about 8 weight percent of a $C_{14}$ to $C_{20}$ fatty acid ingredient;

iv. between about 1 and about 5 weight percent of a polymeric wax crystal modifier ingredient;

v. between about 1 to about 10 weight percent of a volatile active ingredient; and, vi. between about 0.0001 and about 2 weight percent of colorant ingredient; wherein the prilled wax composition has a density between about 0.50 and 0.65 grams per cubic centimeter, and wherein no two adjacent layers contain the same colorant wherein said candle contains at least one axially disposed vertical combustible wick.

28. A method of making a multilayered compression candle, which process comprises the steps of:

A. Preparing x+1, where x is a whole number equal to or greater than 1, solid-fuel prill layer mixtures, each layer mixture containing a compatible solid fuel having a particle size of from about 500 to about 2000 microns, and each layer mixture containing an effective amount of a colorant and optionally, one or more different volatile active ingredients from the group consisting of fragrances, insect control agents, sanitization agents and deodorants;

B. Adding the x+1 layer mixtures of step a to a candle mold in a sequential manner so that no immediately adjacent layer mixture within the mold contains the same colorant, each layer mixture being added in a quantity to produce a substantially horizontal layer of a desired thickness, such mold having placed therein one or more axially disposed wicks;

C. Subjecting such layer mixtures in the mold to a compressive force to form a candle within the mold, said candle having a substantially horizontal top surface, a substantially horizontal bottom surface, and one or more vertical surfaces communicating with said top and bottom surfaces defining the candle, said candle shape having x+1 layers, each layer having a desired thickness, and said wick extends a flame sustaining distance above the substantially horizontal top of such candle; and, D. Removing said candle from the mold to recover a multilayer compression candle.

29. The multilayered compression candle of claim 28 wherein each layer contains:

i. between about 60 and 95% weight percent of refined paraffin wax having a melting point in the range of about 130 and 150° F. and a maximum oil content of about 1.0%, ii. between about 0 and 20 percent of microcrystalline wax having a melt point in the range on 150 to 180° F., iii. between about 2 and 20 weight percent of a $C_{14}$ to $C_{20}$ fatty acid ingredient, iv. between 0 and 5 weight percent of a polymeric wax crystal modifier ingredient;

v. between about 0 to 10 weight percent of a volatile active ingredient, and vi. between about 0 and 2 weight percent of colorant ingredient; wherein the prilled wax composition has a powder density between about 0.50 and 0.65 grams per cubic centimeter.

30. The candle of claim 29.

* * * * *